US005288176A

United States Patent [19]

Huff et al.

[11] Patent Number: 5,288,176

[45] Date of Patent: Feb. 22, 1994

[54] YIELDING GROUT COMPACTOR FOR MINE ROOF SUPPORT FIXTURE

[75] Inventors: Brian K. Huff, Loveland, Colo.; Brian R. Castle; James J. Scott, both of Rollo, Mo.

[73] Assignee: Scott Investment Partners, Rolla, Mo.

[21] Appl. No.: 24,264

[22] Filed: Mar. 1, 1993

[51] Int. Cl.[5] ..... E21D 20/02

[52] U.S. Cl. ..... 405/259.6; 405/259.5; 405/302.2

[58] Field of Search ..... 405/259.1, 259.5, 259.6, 405/288, 302.2

[56] References Cited

U.S. PATENT DOCUMENTS 4,265,571 5/1981 Scott ..... 405/302.2 X
4,378,180 3/1983 Scott ..... 405/259
4,477,209 10/1984 Hipkins, Jr. et al. ..... 405/261
4,518,292 5/1985 Calandra, Jr. ..... 411/82

*Primary Examiner*—David H. Corbin
*Attorney, Agent, or Firm*—Polster, Lieder, Woodruff & Lucchesi

[57] ABSTRACT

A yieldable grout compactor for a cable roof support fixture adapted to be insertable in a uniform diameter borehole or in a stepped borehole in which the grout cartridge and compactor are insertable so as to have the cable perform the piercing and mixing function with respect to the grout material while the compactor is slidable on the cable caused by a sufficient degree of force to permit the grout to surround and anchor the cable. Compactor sleeves are sized with respect to the axial cable length and the internal and external diameters are sized to yieldably permit fixture installation and grout securement of the cable in a manner to obtain a secure anchor for the cable in the back of the borehole.

10 Claims, 3 Drawing Sheets

Another object of the invention is to allow a larger hole to be drilled in one portion of the borehole below the anchor position where drilling problems using small holes may be encountered thereby allowing a compactor sleeve to push a smaller diameter grout cartridge anchor up the larger diameter borehole and finally into the small diameter borehole.

Another object of the invention is to anchor the cable in a small diameter borehole to form an annulus as thin as possible to obtain maximum anchorage by using as little quantity of grout for most efficient use of the grout material.

Another object of the invention is to seal the grout in a small diameter borehole at the juncture of a borehole formed to a 1⅜ inch diameter to keep the grout in the proper place.

Another object of the invention is to design a yieldable compactor sleeve with sufficient frictional contact between the sleeve and the cable to keep the sleeve in firm position at or near the end of the cable until the hydrostatic pressure buildup of the grout which develops at the back of the borehole is sufficient to force the sleeve to slide down the cable, while at the same time obtaining a seal in the borehole that forces the grout to maintain a firm position around the cable so that the grout does not escape.

Another object of the invention is to allow use of highly fluid grout and grout with longer gel times that allow longer mixing to assure uniformity throughout the set up of the grout which provides for obtaining maximum anchorage.

These and other objects of the invention will be set forth in the details of the construction as seen on several views of the drawings.

BRIEF DESCRIPTION OF THE DRAWINGS

The following drawings illustrate the invention in several embodiments, wherein.

DETAILED DESCRIPTION OF THE EMBODIMENTS

Figure 1:
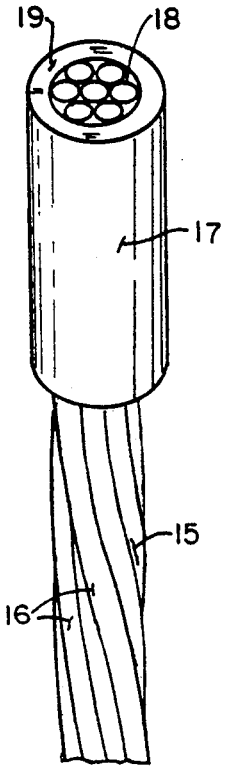
FIG. 1 is a fragmentary schematic view of a compactor sleeve positioned adjacent the leading end of a cable.

The yieldable grout compactor for mine roof support fixtures generally includes a wire strand type cable which is inserted in a borehole so that the end of the cable is adjacent the back of the borehole whereby suitable grout means such as quick-setting resin can be released to form a secure retention of the cable in the borehole. Such a support fixture is shown in a fragmentary way in FIG. 1 where the cable 15 is shown made up of a plurality of wires 16 and with the end portion of the cable 15 surrounded by a yieldable compactor 17 which may be formed of suitable material which can be like plastic material having an internal bore 18 that is frictionally retained in contact with the cable 15 but is slidable or yieldable when pressure is applied to the end face 19 of the compactor sleeve 17.

Figure 2A:
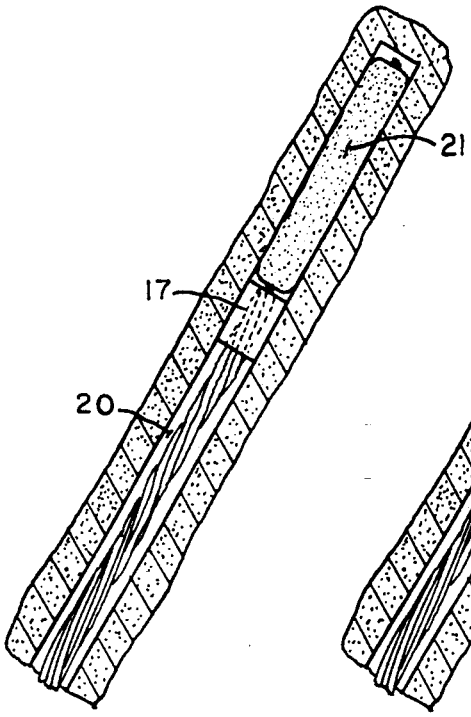
FIG. 2A is a fragmentary sectional view of a compactor carried at the lead end of a cable in position pushing a grout cartridge into the back end of a borehole.

A typical installation of the mine roof support fixture is shown in FIG. 2A where the borehole 20 of substantially uniform diameter is adapted to receive a cartridge 21 containing the grout material which before noted may be a quick-setting resin which when released and mixed by the cable 15 piercing the cartridge will surround the end of the cable that is pushed up through the cartridge 21 to form a thin walled body of grout connection between the cable 15 and the surface of the borehole 20. It is not believed necessary to illustate the opposite end of the cable 15 that is accessible in the mine passage as the present improvement is primarily concerned with the securing of the mine roof support fixture in a borehole which is formed in the rock structure that needs to be supported against collapsing into the passage.

Figure 2B:
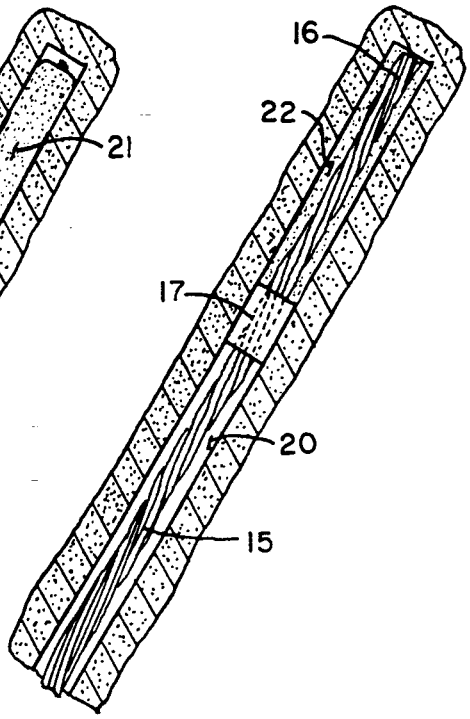
FIG. 2B is a view similar to FIG. 2A in which the cable has pierced the cartridge to release the grout which has forced the compactor to slide down the cable so the grout contents of the cartridge will anchor the cable in the borehole.

FIG. 2B illustrates the condition wherein the cable 15 has its end portion 16 completely penetrating and piercing the cartridge 21 seen in FIG. 2A so as to mix and release the grout 22 to form the connection retaining the cable 15 in the borehole 20. In FIG. 2B there is a slidable compactor 17 which is sized to fit closely in the borehole 20 and has slid to a position to retain the grout material in position to surround the cable and not escape through the borehole 20.

It is to be noted that FIGS. 2A and 2B are intended to illustrate the normal approach of a cable and compactor toward the back end of the borehole 20 so as to position the cartridge 21 where it is most effective to secure the cable 15 as is shown in FIG. 2B.

Figure 3:
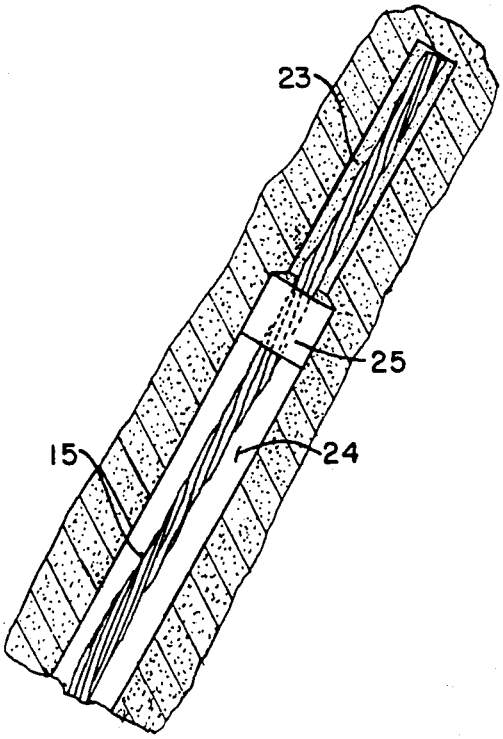
FIG. 3 is a fragmentary schematic view of a modified stepped borehole having a larger diameter length of borehole opening into a smaller diameter borehole, a cable grouted in the smaller borehole, and a compactor forced to assume a position at the end of the larger borehole to prevent escape of grout.

Turning now to FIG. 3 there is shown an embodiment of a stepped borehole having a small diameter portion 23 formed beyond the end of a large diameter borehole portion 24. In a situation shown in FIG. 3 it is often times necessary to rely on different diameter size boreholes so as to penetrate geological material which has evidence of being cracked and broken or which would make it difficult to successfully place a grout cartridge in the small diameter end portion 23 without having it punctured so as to release the grout prematurely. The example of FIG. 3 illustrates the application of a large diameter compactor 25 slidably engaged on the cable 15 so that the compactor 25 reaches a position at the end of the large diameter borehole 24 before the cable 15 has pushed a cartridge not shown into the small diameter portion 23 of the borehole. It is important to delay the piercing of the cartridge until the large diameter compactor 25 has abutted the end of the large diameter borehole 24 so that it is in position to retain the grout material within the small diameter portion 23 of the borehole, thereby obtaining the desired secure retention of the cable 15.

Figure 4:
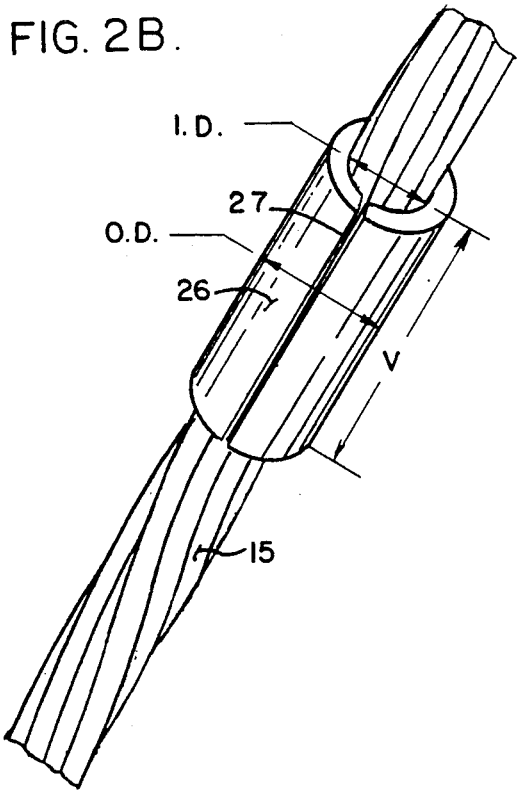
FIG. 4 is a diagrammatic perspective view of a compactor positioned on a cable to illustrate the dimensional characteristics of the compactor to adjust sliding friction of the compactor on the cable.

In the view of FIG. 4 which is a diagrammatic perspective view of a compactor and cable assembly, there is shown in what manner the compactor body 26 can be adjusted to obtain a slidable friction contact with the cable 15. The adjustment is obtained by selecting a desired length L for the compactor sleeve, and sizing the diameter of the central bore I.D. to provide a sliding friction fit with the cable 15. The compactor sleeve 26 can have an outside diameter O.D. so as to be able to just clear a passage into the borehole. Normally a compactor sleeve can be initially fitted over the end of the cable 15 and then moved down the cable to whatever position is desired for initiating insertion of the fixture. In some instances for compactor sleeves having a longer length L than others, the sleeve may have a longitudinal cut 27 which will allow the compactor sleeve to be slightly expanded so that its internal I.D. can be more conveniently temporarily increased in size to ease its fit over the cable 15.

Figure 5:
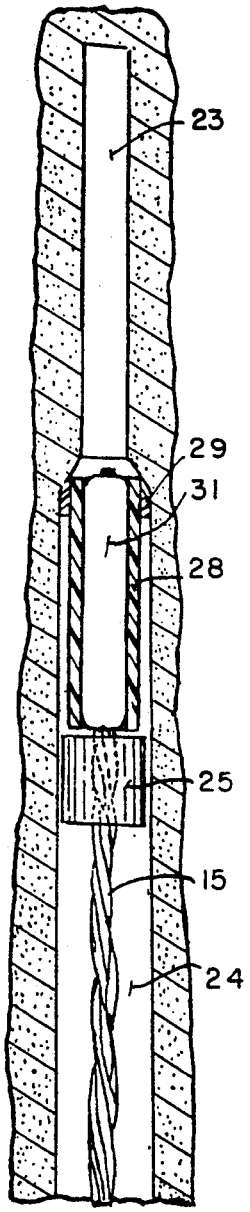
FIG. 5 is a fragmentary sectional view of a stepped borehole in which a grout cartridge is stabilized in the larger diameter borehole by a sleeve advanced by a compactor sleeve thatallows a cable to push the cartridge into the small diameter borehole, the stabilizer sleeve may have a collar to prevent escape of grout outside of the stabilizer sleeve.

With respect to FIG. 5 of the drawings there is shown a stepped borehole in which the larger diameter borehole 24 opens into a smaller diameter borehole 23. This view differs from FIG. 3 which is also a stepped borehole disclosure in respect of the placement of a stabilizer tube 28 which is advanced through the large diameter borehole 24 by a compactor 25 frictionally and slidably carried on the cable 15. The tubular means 28 may be formed with a collar 29 at the leading end so as to maintain the tubular member 28 so that its bore is centered to the small diameter borehole 23. The tubular member 28 carries a grout capsule 31 which is stabilized and protected by the tubular member 28 during the passage of the capsule 31 into the small diameter borehole 23. The capsule is pushed by the end of the cable 15 and is intended to slide fairly easily until it encounters the back of the borehole 23. On encountering the back of the borehole 23 the cable 15 will pierce the capsule 31 and release and mix the grout to surround the cable 15. The grout will distribute itself around the cable 15 but will not be allowed to escape from the borehole 23 due to the presence of the tubular member 28. Since the grout may be a quick-setting resin material it is believed that there will not be sufficient time for the grout to escape into the bore of the tubular member 28.

Figure 6:
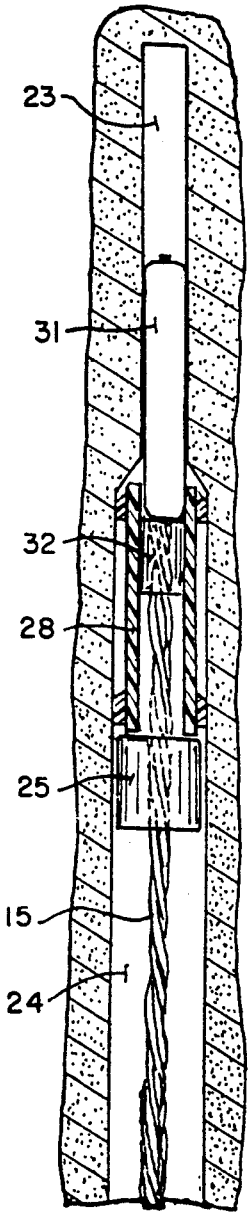
FIG. 6 is a view similar to FIG. 5 in which the stabilizer sleeve directs a small diameter compactor to push a grout cartridge into the small diameter borehole while a large diameter compactor is used to advance the stabilizer sleeve in the large diameter borehole.

The disclosure in FIG. 6 is somewhat similar to FIG. 5 except that the stabilizing tubular member 28 is utilized to direct a compactor sleeve 32 carried near the end of the cable 15. The compactor 32 is in position to advance the capsule 31 into the small diameter borehole 23 and form a position locator at the entrance to the borehole 23 while the cable 15 extends beyond the compactor 32 and pierces the capsule 31 to release and mix the grout. The tubular member 28 is retained in the large diameter borehole 24 by the compactor 25 as before referred to in FIG. 5.

In order to provide for the efficient mixing in larger diameter boreholes of the grout it is contemplated that the cables 15 can be modified to have a bird cage type enlargement 34 at the end thereof which passes through the borehole 24 and pushes the capsule 21 into the back of the borehole before the bird cage 34 pierces the grout cartridge 21 in order to perform the mixing function which is obtained by rotation of the cable 15 as the cable 15 and bird cage 34 are advanced into the borehole 24 while the compactor 25 is brought up against the grout so as to retain the grout in position to surround and anchor the cable 15 with its bird cage 34 embedded in the grout material.

Figure 7A:
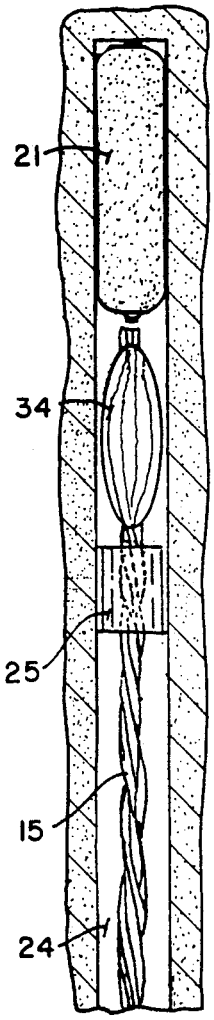
FIG. 7A is a fragmentary schematic view of a cable for inserting and mixing the grout in a cartridge upon the cartridge being pierced by the formation on the end of a cable of a bird cage which performs a mixing function upon rotation of the cable.
Figure 7B:
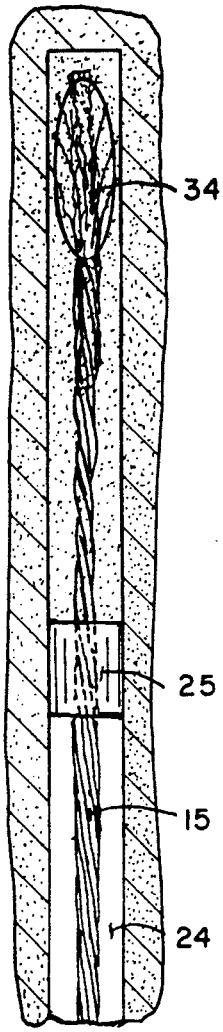
FIG. 7B is a fragmentary schematic view of the bird cage form of cable having accomplished the mixing of the grout which is retained in the borehole.

The cable 15 formed with a bird cage 34 for mixing the grout can, of course, be embodied in any of the installation drawings previously described. While FIGS. 7A and 7B illustrate the bird cage mixing feature, it is understood that the physical dimension of the bird cage 34 or other character of mixing means must be selected so that it will be easily insertable in a borehole, or easily passed through the stabilizing tubular means 28 shown in FIGS. 5 and 6. In each view the bird cages 34 are formed by expanding the cable wires by inserting an element 36 on the center wire 37 so it holds the surrounding wires 38 in the desired expanded positions.

Figure 8A:
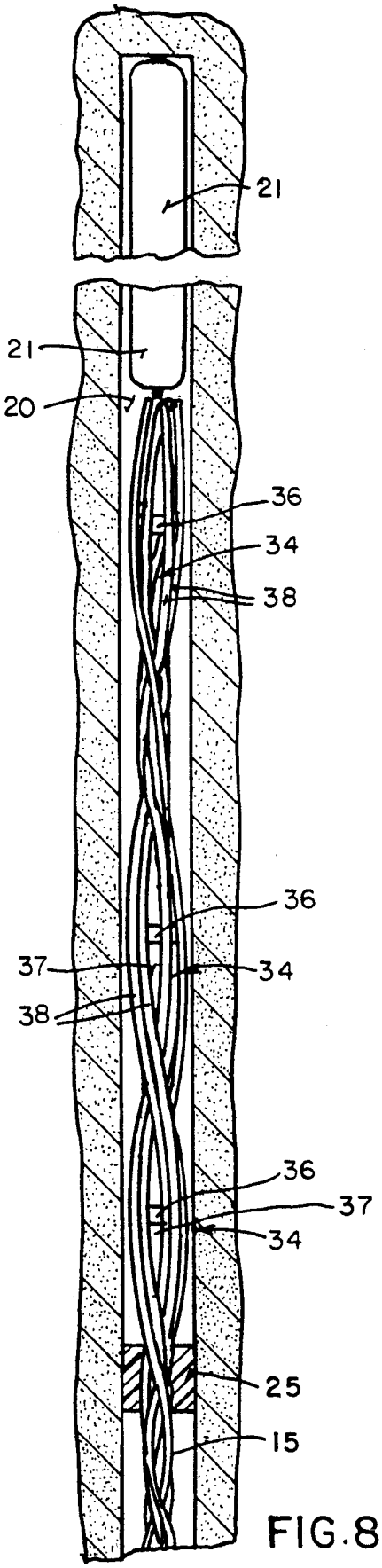
FIG. 8A is an enlarged fragmentary view of a cartridge pushed into the back of a borehole by a cable having a series of bird cages for mixing the grout after the cartridge is pierced.
Figure 8B:
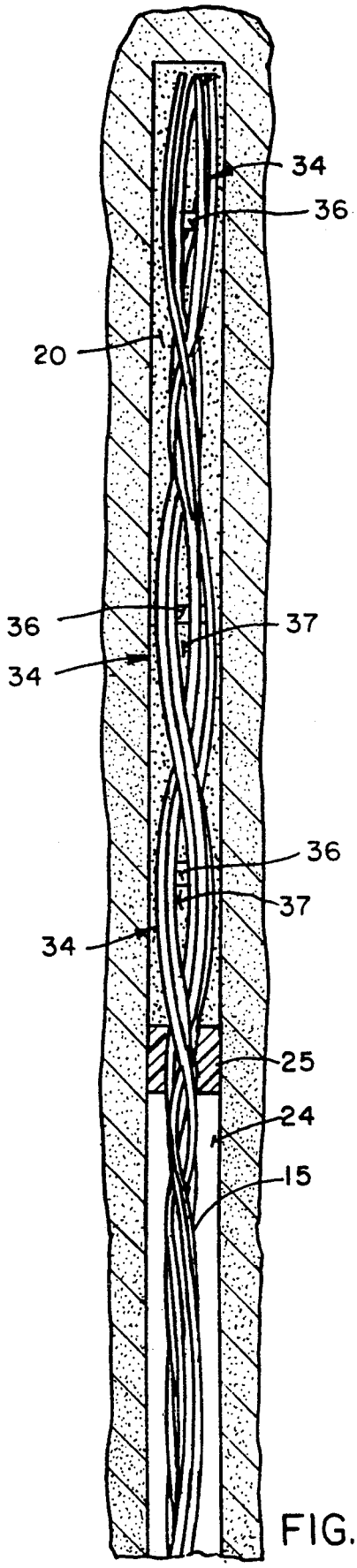
FIG. 8B is a view similar to FIG. 8A showing the effect of piercing the cartridge and rotating the cable bird cages to mix and set the grout while a compactor retains a position to prevent escape of the grout.

As suggested in the foregoing description, FIGS. 8A and 8B illustrate a cable 15 formed with a series of bird cages 34 advancing ahead of a compactor 25 to push a grout cartridge 21 into the back of the borehole 20 which has a substantially uniform diameter. Upon reaching the back of the borehole the leading end of the cable 15 pierces the cartridge, as is seen in FIG. 8B, and mixes the grout to form a solid body as a result of the action of a suitable catalist.

In the examples shown and described for a borehole having a diameter of about one inch, the compactor 17 may have a length L and an outside diameter O.D. chosen for the need of the O.D. to pass into the borehole without encountering projections that could impede passage. The length L is normally selected based on the need to have a surface contact with the borehole that develops friction of a value to force the grout to fully surround the cable 15 and also be substantially free of voids and air bubbles. A further consideration to be given to the compactor 17 is the need to have the I.D. chosen so the compactor has sufficient friction contact with the cable 15 so it will slip on the cable 15 very slowly thereby causing the grout to set up while it substantially surrounds the cable to form a load retention.

According to the foregoing specification I have explained the principal, preferred construction, and mode of operation of my invention, and have illustrated and described what I now consider to represent the best embodiments thereof. However, it should be understood that the invention herein may be practiced within the scope of the disclosure with a certain degree of variation that will remain consistent with the scope of the disclosure.

What is claimed is:

1. In a yieldable grout compactor for a cable support fixture to be positioned in a borehole in a geologic formation and secured by resinous grout contained in a cartridge positioned in such a borehole, the improvement comprising a tubular compactor means having an internal bore to receive initially at least the end portion of a cable in position to push a grout containing cartridge into a borehole, said tubular compactor means fitting the borehole and directing the cable into position to pierce said cartridge upon the cartridge bottoms in the borehole and effects release of the grout, and said tubular compactor means being adapted to yield to the pressure exerted by release of grout and slide on the cable as the cable advances toward the back of the borehole where it is to be secured by the setting of the grout.

2. The improvement set forth in claim 1 wherein said internal bore of said tubular compactor means is dimensionally adjusted to obtain a slidable friction contact with said cable so it effects an attachment to said cable by friction between said cable surface and said internal bore.

3. The improvement set forth in claim 1 wherein said tubular compactor is longitudinally formed so the internal bore of said tubular compactor means is temporarily expandable so it exerts a friction contact on said cable for pushing said cartridge to the back of the borehole to pierce said cartridge by said cable whereby said grout exerts an hydraulic back pressure on said tubular compactor means to forcibly slide it on said cable.

4. The improvement set forth in claim 1 wherein said tubular compactor means establishes a seal in said borehole for retaining released grout to surround said cable end beyond the compactor and secure the cable adjacent the back of the borehole.

5. The improvement set forth in claim 1 wherein the resinous grout has a fluid characteristic when the cartridge is pierced by said cable and said tubular compactor means is dimensionally sized as to diameter and length so it serves to hold the grout in the borehole for the predetermined setting time of the grout.

6. In a yieldable grout compactor for a cable roof support fixture positioned in a mine roof geologic formation having an elongated borehole in the geologic formation characterized by a small diameter portion and a large diameter borehole portion for receiving said cable support fixture; the improvement comprising: a cable support fixture; a grout compactor sleeve received on said cable support fixture and dimensionally sized to be movable in said large diameter borehole portion; a grout containing cartridge positioned in said small diameter borehole portion in contact with said cable support fixture; said cable support fixture having an end portion for piercing said cartridge against the back of said small diameter borehole, and said grout compactor sleeve being moved by said cable support fixture to a position for retaining the grout in said small diameter borehole.

7. In a yieldable grout compactor means for a cable support fixture positioned in a mine passage formation having a stepped borehole in a wall or roof having large and small diameter sizes, the improvement comprising a tubular stabilizer positioned in said large diameter size borehole, a grout containing cartridge slidable through said tubular stabilizer, and a cable for the mine support fixture movable through said tubular stabilizer, said cable having an end presented in said tubular stabilizer to push said cartridge into said small diameter size borehole, and said tubular stabilizer retaining a position to substantially center said cable and confine grout in said small diameter size borehole.

8. The improvement set forth in claim 7 wherein a compactor means engages said tubular stabilizer to retain it in grout confining position.

9. The improvement set forth in claim 7 wherein a compactor means is mounted on said cable and is slidable in said tubular stabilizer to push said grout containing cartridge into said small diameter size borehole and retain said grout in the small borehole.

10. The improvement set forth in claim 7 wherein said grout compactor sleeve includes a large diameter compactor engaged on said tubular stabilizer positioned in said large diameter size borehole, and a small diameter compactor is slidably mounted in said tubular stabilizer by said cable for the mine support fixture.

* * * * *